US005652503A

United States Patent [19]

Urban et al.

[11] Patent Number: 5,652,503

[45] Date of Patent: Jul. 29, 1997

[54] CONTROL SYSTEM FOR EVEN LIGHTING OF SURFACE ELEMENTS IN A GLASS COOK TOP

[75] Inventors: Frederick M. Urban, Barrington; Robert J. Alvord, Elmwood Park, both of Ill.

[73] Assignee: Eaton Corporation, Cleveland, Ohio

[21] Appl. No.: 570,853

[22] Filed: Dec. 12, 1995

[51] Int. Cl.[6] ..... H05B 6/08

[52] U.S. Cl. ..... 323/235

[58] Field of Search ..... 363/97, 131; 323/902; 219/10.77

[56] References Cited

U.S. PATENT DOCUMENTS 5,010,223 4/1991 Kim ..... 219/10.77

*Primary Examiner*—Aditya Krishnan

*Attorney, Agent, or Firm*—Jennifer M. Stec; Roger A. Johnston

[57] ABSTRACT

A triac-based electronic control system (20) for an electrical appliance which alternately applies and disrupts power in full cycles or full half cycles. Each zero crossing in a wave cycle is detected and this information is input into a microprocessor (U1) along with a user selected power level. The microprocessor outputs a triac control signal (36) to alternately turn ON and turn OFF power to a heater element (22) to produce a duty cycle used to achieve the desired heating level.

16 Claims, 2 Drawing Sheets

CONTROL SYSTEM FOR EVEN LIGHTING OF SURFACE ELEMENTS IN A GLASS COOK TOP

BACKGROUND AND SUMMARY OF THE INVENTION

This invention relates generally to electronic appliance control systems and, more particularly, to a full half cycle triac control system for glass cook top applications.

Glass cook top units generally employ either halogen or radiant heating elements to heat items placed thereon and to provide a radiant glow which is visually indicative of the current power level. Generally, electronic or electromechanical systems used to control the transmission of energy from a supply source to the heating elements are turned fully ON when a 100% power level is selected but are pulsed to provide less than full power. This method typically enables efficient and effective heating element control. However, providing a uniform heating element glow or brightness, which is reduced proportionally with a reduction in power level without any visible flickering or pulsing, has proved to be more difficult to achieve.

To get an even glow at less than 100% power levels, some cook tops employ a control system based on an alternating current switch in the form of a phased triac. However, this type of control system has a substantial drawback in that it requires a large heat sink as well as large inductors in series in order to work effectively. These systems also inherently create undesirably high dI/dt and dV/dt characteristics in the control signal and tend to be too expensive to use on all but top of the line appliances.

The electronic control circuit of the present invention provides a significant improvement over traditional triac based control systems of this type with full half cycle triac control rather than a phased triac approach. Power levels are created by turning the element ON for one or more full half cycles and then OFF for a whole number of half cycles in order to create a duty cycle approaching the desired power level. This provides adjustable heating element control and eliminates the high voltage and current rise rates implicit with phased triac control. The large heat sinks and series inductors needed for phased triac control are also reduced in terms of both size and cost. These and other features and advantages of the present invention will become apparent upon review of the following description taken in conjunction with the accompanying drawings.

DETAILED DESCRIPTION OF THE PREFERRED EMBODIMENT

Figure 1:
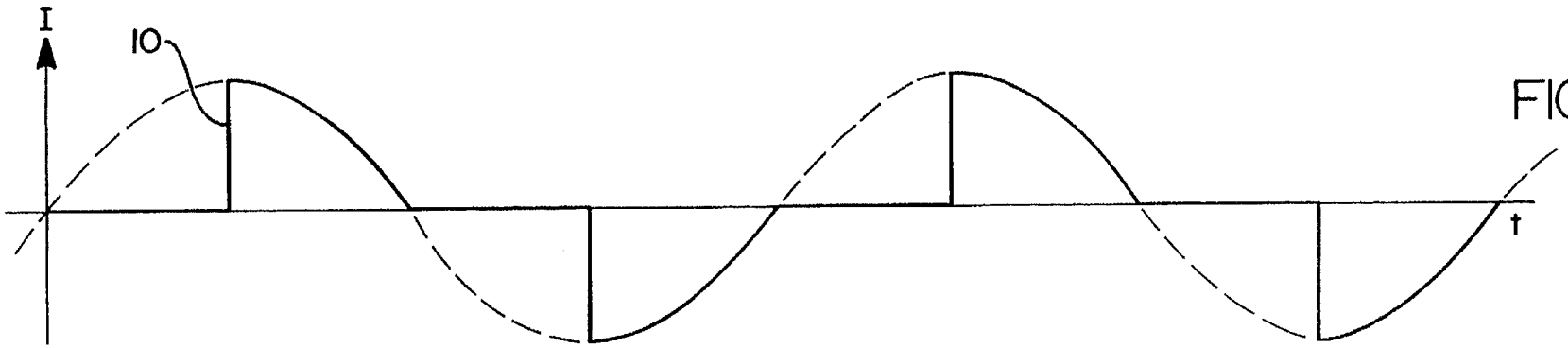
FIG. 1 is a graph of the electrical current versus time produced by a traditional phased triac control system.

Turning now to the drawings, and in particular to FIG. 1, electrical current is plotted with respect to time for a traditional phased triac based control system. In this type of system the triac is fired every half cycle at a specific phase angle necessary to produce the desired proportion of ON time to OFF time. However, this method inevitably produces a signal having large dI/dt characteristics, indicated in the graph at 10. Although the signal shown is produced by turning ON at 90° and 270° to produce a 50% power output, turning ON earlier to produce a higher power level or later to produce a lower level, still results in the same general curve shape and the same sharp current rise rates. This large dI/dt can produce several undesirable effects, including line noise, higher surge stresses in the heating element and high power in the triac.

Figure 2:
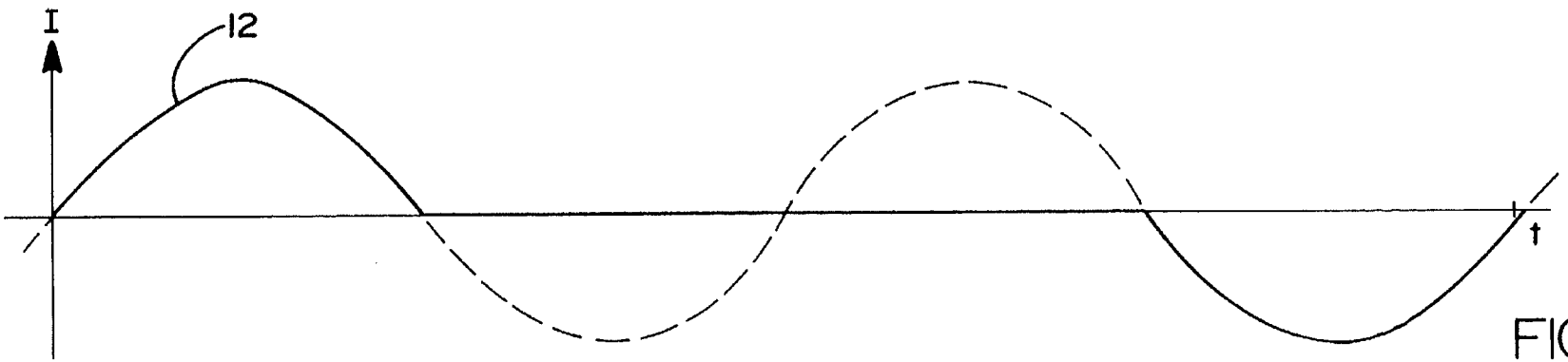
FIG. 2 is a graph similar to FIG. 1 showing electrical current versus time produced by the full half cycle triac control system of the present invention.

A more desirable current versus time plot for a triac control circuit, that produced in accordance with the control circuit of the present invention and utilizing full half waves, is shown in FIG. 2. Unlike with a phased triac control system, power is turned ON substantially at zero line crossings as well as OFF. As shown in the figure, for a 33% desired power level the power would be turned ON for a complete half cycle and then left OFF for two complete half cycles. With this type of full half cycle control, changes in current with respect to time (see line segment 12) are much more gradual while the same overall result is achieved. Current can also be turned ON beginning with negative rather than positive half waves. Switching current both ON and OFF approximately at zero line crossings in this fashion is particularly desirable in that lower surges are put on the heating element and much less line noise is created.

Similarly, for a 20% desired power level the current would be turned ON for one half cycle and then OFF for four; for 66% the current would be ON two half cycles and OFF one. However, it should be noted that turning current OFF for an even number of half cycles eliminates the DC component of current. Turning current OFF for an odd number of half cycles, such as to provide a 66% power level as mentioned above, does provide the correct power level, but DC current is drawn from the power line. While half wave bridge rectifiers are in use and pull DC, where possible an even number of OFF half cycles is preferably used.

In addition to achieving a desired power level, the glow time constants of halogen and radiant heating elements also are preferably considered. The time necessary to achieve full glow has been observed to be greater than one half cycle (8 msec) but less than 200 msec. If an element is turned ON for only one half cycle and then OFF for less than four half cycles the element generally will not appear to flicker. While the present invention is also capable of providing various power levels by turning ON and OFF using full cycles rather than half cycles, full cycle ON has been shown to cause flicker. The reason is that the element gets hotter after a full cycle and cools off faster. Also, for a given power level, the time OFF is twice as long with full cycle control, resulting in half the frequency.

The apparent modulation of the glow is greater due to higher temperature and lower frequency. Also, the refresh rate of the human eye comes into play. Above 30 to 60 Hz, the eye will integrate out flickering of the elements. Ambient light, the individual observer and other conditions affect the perception of flicker.

In subjective tests, flicker was observed with a halogen element above 10% but below 20% power when half cycle control was utilized. Flicker was observed much more with full cycle control. The flicker at power levels below 10% was not easily observable because the element did not appear to glow at all. The observable flicker at power levels between 10 and 20% was judged to be acceptable or even desirable since it resembled the flickering of a gas burner, which is what a halogen element attempts to visually simulate. The results for radiant elements were similar except that no glow at all was observed at power levels below 40 to 50% using the present half cycle control method.

The perception of flicker by the human eye as well as heat transfer integration by actual cooking load makes the present control method work. The key is to stay above the perception frequency of the eye (about 30 Hz) and to transfer heat to the cooking load below its time constant. While it is possible to introduce some flickering at high power levels by adding occasional full cycle control to make a gas burner type of flicker in halogen elements, preferably half cycle control is used to provide a base glow without objectionable on/off flicker.

Figure 3:
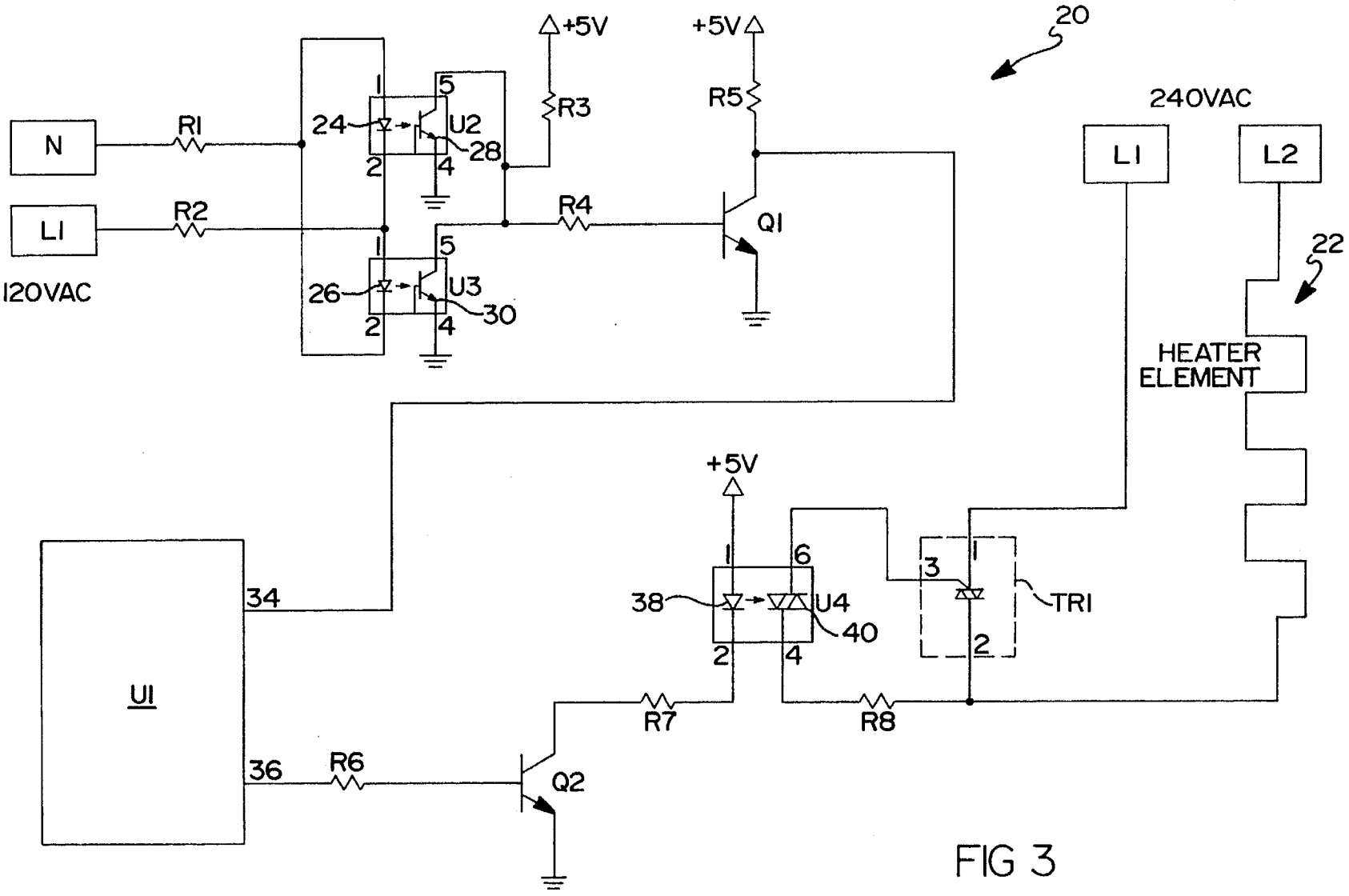
FIG. 3 is a schematic diagram of the present control circuit.

The electronic circuit used to accomplish this type of control is indicated generally at 20 in FIG. 3. As shown therein, a heater element 22 is turned alternately OFF and ON in accordance with the strategy described above. While heater element 22 in this exemplary embodiment is a halogen element, this circuit and method will work on radiant cooktop heat elements or even in other types of applications equally as well. A line voltage of 120 V alternating current (ac) L1 and a neutral line N are electrically coupled to a pair of opto-isolators U2 and U3, this being done through resistors R1 and R2. Opto-isolators U2 and U3 are able to anticipate and/or detect each zero crossing of the applied alternating current electrical signal. As current flows through light emitting diodes (LEDs) 24 and 26 of U2 and U3, they are illuminated, thereby turning ON the respective bases of transistors 28 and 30.

A 5 V logic voltage is applied to the collectors of transistors 28 and 30 through a resistor R3 and a node 32, with the respective transistor emitters tied to ground. Node 32 is also coupled through a resistor R4 to the base of a transistor Q1. The emitter of Q1 is grounded and the collector is coupled through R5 to a 5 V source and to an input 34 of a microprocessor U1. Q1 outputs a signal to U1 that pulses briefly at each zero crossing of the ac input signal, in both the positive and negative directions. U2 and U3 are preferably configured, in a manner known to those of skill in the art, to cause the leading edge of the pulse on input 34 to occur slightly before the actual zero line crossing, thereby allowing microprocessor U1 a sufficient amount of time to respond.

Based upon software algorithms programmed into microprocessor U1, along with input signal 34, an output signal is provided at 36 through a resistor R6 to the base of a transistor Q2. The emitter of Q2 is grounded with the collector connected through a resistor R7 to an opto-triac U4, which is electrically coupled to a 5 V logic voltage. The LED 38 of opto-triac U4 optically triggers triac 40 which in turn triggers pin 3 of triac TR1, causing it to conduct for the remainder of a line cycle, until the next zero crossing. Opto-triac U4 and triac TR1 are also coupled through a resistor R8, with the opto-triac providing isolation between microprocessor U1 and a higher voltage side of the circuit. Microprocessor U1, responsive to a user selected power level and to zero line crossing indications received on signal 34, provides appropriate start signals on output 36, in combination with triac TR1, to cycle power ON and OFF. To accomplish the same function with full cycle control, the software algorithm turns the triac ON or OFF in even numbers of consecutive half line cycles, according to the desired duty cycle.

Circuit 20 thus provides triac control on a full half cycle basis, eliminating the need for large heat sinks and series inductors inherent in more traditional phased triac control systems, while producing effective heat element control and an even brightness down to power levels of about 10%. Below a 10% power level, the heating element is still effectively controlled by this circuit down to less than 2% but at these low levels, it is not necessary that the element produce any visible light.

For purposes of clarity the component values for an exemplary embodiment of the present invention have been omitted from circuit 20 in FIG. 3, but for completeness are provided in the table below.

| Resistors | | Other | |
|---|---|---|---|
| R1 | 24kΩ | U1 | CD4089BC |
| R2 | 24kΩ | U2 | 4N25 |
| R3 | 47kΩ | U3 | 4N25 |
| R4 | 1kΩ | U4 | M0C3022 |
| R5 | 10kΩ | Q1 | 2N4401 |
| R6 | 10kΩ | Q2 | 2N4401 |
| R7 | 150Ω | TR1 | MAC15 |
| R8 | 150Ω | | |

The foregoing discussion discloses and describes an exemplary embodiment of the present invention. One skilled in the art will readily recognize from such discussion, and from the accompanying drawings and claims, that various changes and modifications can be made without departing from the spirit and scope of the invention as defined by the following claims.

What is claimed is:

1. An electronic control system for an electrical appliance comprising:

a source of alternating electrical current having a repeating current wave cycle;

circuit means for producing a signal pulse substantially at each zero crossing of said current wave;

microprocessor means for receiving a value representative of a desired appliance power level and said pulsed signal, said microprocessor producing an output signal in response to said value and said received pulse; and switch means responsive to said output signal and electrically coupled between said ac power source and said appliance, said switch means for allowing the conduction of current to said appliance for a specified number of full half cycles of said alternating electrical current said half cycles beginning and ending substantially at said zero crossings.

2. The control system of claim 1 wherein said switch means comprises a triac.

3. The control system of claim 1 wherein said circuit means includes an opto-isolator.

4. The control system of claim 1 wherein said pulse providing means includes a transistor.

5. The control system of claim 4 wherein said transistor is electrically coupled between said opto-isolator and said microprocessor.

6. The control system of claim 1 further comprising an opto-triac for triggering said triac means.

7. The control system of claim 5 wherein said opto-triac is turned ON by a transistor.

8. The control system of claim 1 wherein said appliance is a range or cooktop and said control system controls the application of power to a heating element of said range or cooktop.

9. A method of operating an electronic control system for an electrical appliance comprising the steps of:

electrically connecting said appliance control system to a source of alternating electrical current having a repeating current wave cycle;

providing circuit means for producing a pulse substantially at each zero crossing of said current wave;

selecting a desired power level for said appliance;

providing a switch means between said alternating current source and said appliance; and providing a microprocessor for controllably operating said switch means in accordance with said input power level and said zero crossings, said switch means being operated to apply power to said appliance for a number of full half cycles and then disrupt the application of power to said appliance for a full number of half cycles.

10. The method of claim 9 wherein said power is applied for an even number of consecutive half cycles and then disrupted for an even number of consecutive half cycles.

11. The method of claim 9 wherein said switch means comprises a triac.

12. The method of claim 9 wherein said circuit means includes an opto-isolator.

13. The method of claim 9 wherein for a desired power level of 50% said current is turned alternately ON and OFF at each consecutive zero crossing.

14. The control system of claim 1 wherein said circuit means produces said pulse just prior to said zero crossing.

15. The method of claim 9 wherein said pulse is produced by said circuit means just prior to a said zero crossing.

16. An electronic control system for selectively applying power to a heating element of a cooking appliance comprising:

a source of alternating electrical current having a repeating current wave cycle;

an opto-isolator circuit for indicating each zero line crossing of said alternating current wave cycle;

a transistor circuit responsive to said optoisolator circuit for producing a pulse substantially at each said zero crossing;

a microprocessor for receiving a value representative of a desired appliance power level and said pulse, said microprocessor producing an output signal in response to said value and said received pulse; and a triac circuit electrically coupled between said power source and said appliance heater element, said triac circuit being responsive to said output signal for allowing the conduction of current to said appliance for a specified number of half cycles, said half cycles beginning and ending substantially at said zero crossings.

* * * * *